United States Patent [19]

Franke

[11] 4,104,525

[45] Aug. 1, 1978

[54] X-RAY DIAGNOSTICS INSTALLATION COMPRISING A SHORT-TERM SWITCHING MECHANISM

[75] Kurt Franke, Erlangen, Germany

[73] Assignee: Siemens Aktiengesellschaft, Berlin & Munich, Fed. Rep. of Germany

[21] Appl. No.: 785,748

[22] Filed: Apr. 8, 1977

[30] Foreign Application Priority Data

Aug. 18, 1976 [DE] Fed. Rep. of Germany ..... 2637161

[51] Int. Cl.[2] ..... H05G 1/56

[52] U.S. Cl. ..... 250/402; 250/403

[58] Field of Search ..... 250/403, 413, 421, 402

[56] References Cited

U.S. PATENT DOCUMENTS 3,110,810 11/1963 Fransen ..... 250/413

*Primary Examiner*—Alfred E. Smith
*Assistant Examiner*—T. N. Grigsby
*Attorney, Agent, or Firm*—Hill, Gross, Simpson, Van Santen, Steadman, Chiara & Simpson

[57] ABSTRACT

In the illustrated embodiment, delay in switching off the x-ray tube is reduced by mounting a switching triode directly on the x-ray tube housing between one terminal of the x-ray tube and the end of the high voltage cable normally connected therewith. The switching attachment may plug into the x-ray tube terminal leading to the cathode and the high voltage cable may plug into a cathode terminal of the switching attachment.

2 Claims, 2 Drawing Figures

X-RAY DIAGNOSTICS INSTALLATION COMPRISING A SHORT-TERM SWITCHING MECHANISM

BACKGROUND OF THE INVENTION

The invention relates to an x-ray diagnostics installation comprising a switching mechanism for a short-term switching-on of the x-ray tube.

In modern x-ray diagnostics, for example in the case of x-ray diagnostics installations comprising motion picture cameras, shorter switching times are in ever more frequent demand. In order to achieve shorter switching times, the use of an x-ray tube with a control grid is known, the switching on and off of the x-ray tube being directly carried out via the control grid. The arrangement of a switching tube in the secondary circuit of the high voltage transformer whereby the x-ray tube can be switched on and off is also known. However, in utilizing a switching tube such as this, the switching times cannot be shortened beyond a specific (or specified) extent, because the mAs-quantity in the high voltage cables contributes to the exposure of the film as well.

SUMMARY OF THE INVENTION

The object which is the basis of the invention consists in producing an x-ray diagnostics installation of the type initially cited wherein, with the aid of a normal x-ray tube, i.e. an x-ray tube not equipped with a control grid, shorter switching times can be achieved than in the known x-ray diagnostics installations, and wherein particularly the mAs-quantity in the high voltage cables does not contribute to the exposure of the film.

As specified by the invention, this object is achieved in that the switching mechanism is installed directly on the x-ray tube housing between one terminal of the x-ray tube and the end of the high voltage cable. Since, in the inventive x-ray diagnostics installation, the switching mechanism is directly connected to the one terminal of the x-ray tube, the mAs-quantity in the high voltage cables has no effect on the film exposure. In order to avoid possible surge voltages during switching-off, it is advisable to connect high voltage capacitors in parallel with the x-ray tube. Since, according to modern technology, the high voltage generators frequently are already provided with capacitors, these capacitors can be utilized for this purpose.

Other objects, features and advantages of the invention will be apparent from the following detailed description taken in connection with the accompanying sheet of drawings.

DETAILED DESCRIPTION

Figure 1:
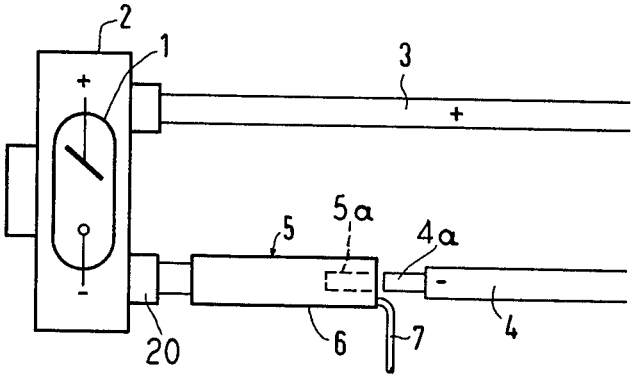
FIG. 1 is an illustration of an x-ray diagnostics installation according to the invention.

In FIG. 1, an x-ray tube 1 is illustrated in a housing 2. Two high voltage cables 3 and 4 lead to x-ray tube 1. A short-term switching attachment 5 is secured to the negative terminal of x-ray tube 1 directly on housing 2. The short-term switching attachment comprises, in a housing 6 which is composed of sheet metal for example, the components necessary for switching x-ray tube 1 on and off. High voltage cable 4 is connected to short-term switching attachment 5 by means of a plug connection.

Of course, in addition to high voltage cable 4, there are other electrical conductors leading to short-term switching attachment 5 which control the switching on and off of x-ray tube 1. In FIG. 1, a control cable containing such conductors is designated by reference numerals 7.

Figure 2:
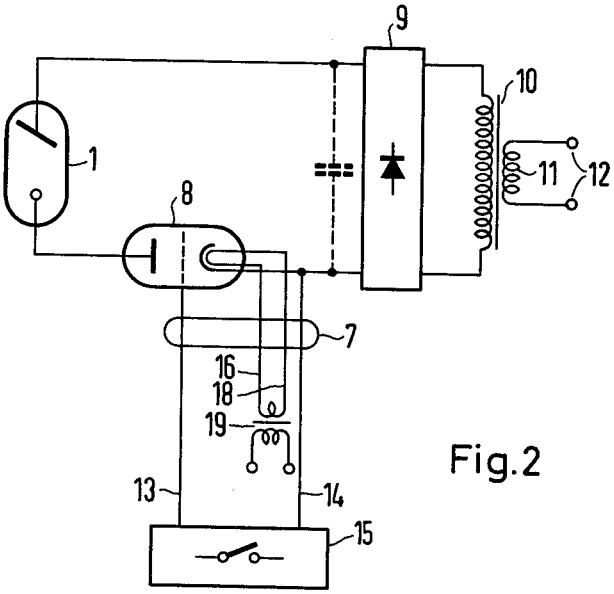
FIG. 2 is a detailed exemplary circuit diagram conforming with the embodiment of FIG. 1 for use in explaining the illustrated embodiment.

From FIG. 2, it is apparent that a switching triode 8 which is contained within housing 6 of attachment 5, FIG. 1, is disposed to control current flow in the anode-cathode feed line of x-ray tube 1 for the purpose of switching x-ray tube 1 on and off. The cathode of switching triode 8, and the anode of x-ray tube 1 are connected to a high voltage rectifier 9 fed by a high voltage transformer 10. The primary winding 11 of high voltage transformer 10 can be connected to the main supply via terminals 12.

Leading to switching triode 8, on the one hand, are two lines 13 and 14, which, with the aid of a control mechanism 15, selectively connect the control grid of switching triode 8 to a potential blocking the current flow through x-ray tube 1, or which selectively connect said control grid to a potential releasing (or unblocking) this current flow; i.e., x-ray tube 1 is capable of being switched on and off by switching means 15. Additionally leading to switching triode 8 are lines 16 and 18 which lead to a filament transformer 19 providing the heating voltage for switching triode 8. Lines 13, 14, 16, 18 form control cable 7.

FIG. 2 additionally illustrates in broken lines a high voltage capacitor which collects the voltage peaks during the switching off of the x-ray tube 1, by means of triode 8.

The switching attachment 5 may have a plug connection with negative terminal 20 of the x-ray tube, similar to the plug connection indicated at 4*a*, 5*a* in FIG. 1.

It will be apparent that many modifications and variations may be effected without departing from the scope of the novel concepts and teachings of the present invention.

I claim as my invention:

1. An x-ray diagnostics installation comprising an x-ray tube having a housing and terminal means connected to one of the electrodes of the x-ray tube, a high voltage cable for connection with the one electrode, and a switching mechanism for a short-term switching on of the x-ray tube, characterized in that the switching mechanism is mounted directly at the x-ray tube housing between said terminal means of the x-ray tube and an end of said high voltage cable.

2. An installation according to claim 1, characterized in that the switching mechanism is arranged at the terminal means connected with the negative electrode of the x-ray tube.

* * * * *